United States Patent [19]

Collins et al.

[11] 3,974,410

[45] Aug. 10, 1976

[54] ALUMINA CERAMIC LAMP HAVING ENHANCED HEAT CONDUCTION TO THE AMALGAM POOL

[75] Inventors: Byron R. Collins, Twinsburg; Charles I. McVey, Shaker Heights, both of Ohio

[73] Assignee: General Electric Company, Schenectady, N.Y.

[22] Filed: Nov. 3, 1975

[21] Appl. No.: 628,203

Related U.S. Application Data

[63] Continuation-in-part of Ser. No. 565,191, April 4, 1975, abandoned.

[52] U.S. Cl. ..... 313/42; 313/43; 313/46; 313/47; 313/229

[51] Int. Cl.[2] ..... H01J 61/52

[58] Field of Search ..... 313/42, 43, 46

[56] References Cited

UNITED STATES PATENTS

| | | | |
|---|---|---|---|
| 3,450,924 | 6/1969 | Knochel et al. | 313/42 X |
| 3,558,963 | 1/1971 | Hanneman | 313/184 |
| 3,716,743 | 2/1973 | Mizumo et al. | 313/220 |
| 3,723,784 | 3/1973 | Sules et al. | 313/47 |

*Primary Examiner*—R. V. Rolinec
*Assistant Examiner*—Darwin R. Hostetter
*Attorney, Agent, or Firm*—Ernest W. Legree; Lawrence R. Kempton; Frank L. Neuhauser

[57] ABSTRACT

A high intensity sodium vapor lamp comprises a tubular envelope of alumina ceramic provided with end closures and containing a charge of sodium mercury amalgam in excess of that vaporized during operation. One closure includes a refractory metal tube sealed off at its tip and wherein unvaporized excess of amalgam collects as a liquid pool. In order to have a sufficiently high temperature at the amalgam pool, a metal slug of high heat conductivity such as molybdenum is placed in it and extends from the seal region towards the tip. Such slug also prevents overheating the seal between the ceramic tube and the end cap.

12 Claims, 4 Drawing Figures

ALUMINA CERAMIC LAMP HAVING ENHANCED HEAT CONDUCTION TO THE AMALGAM POOL

This is a continuation-in-part of application Ser. No. 565,191, filed Apr. 4, 1975, now abandoned, and similarly titled.

The invention relates to high pressure metal vapor lamps and more specifically to the lower wattage sizes of high pressure sodium vapor lamps utilizing alumina ceramic envelopes.

BACKGROUND OF THE INVENTION

High intensity sodium vapor lamps of the present kind are described in U.S. Pat. No. 3,248,590 — Schmidt, entitled "High Pressure Sodium Vapor Lamp." These lamps utilize a slender tubular envelope of light-transmissive ceramic resistant to sodium at high temperatures, suitably high density polycrystalline alumina or synthetic sapphire. The filling comprises an amalgam of sodium and mercury along with a rare gas to facilitate starting. The ends of the alumina tube are sealed by suitable closure members affording connection to thermionic electrodes which may comprise a refractory metal structure activated by electron emissive material. The ceramic arc tube is generally supported within an outer vitreous envelope or jacket provided at one end with usual screw base. The electrodes of the arc tube are connected to the terminals of the base, that is to shell and center contact, and the interenvelope space is usually evacuated in order to conserve heat.

In one ceramic lamp construction which has gone into extensive commercial use, each end of the alumina tube is sealed by a refractory metal closure member having a skirt portion which fits around the end of the alumina tube and is bonded thereto by a thin annular layer of glassy sealing material comprising aluminum oxide, calcium oxide, magnesium oxide, and barium oxide. Each end cap supports an electrode extending along the axis of the tube and is an electrical connector to the electrode. At least one of the end caps, that which is located lowermost in operation of the lamp, has a metal tube projecting hermetically through its end which is used as an exhaust tube during manufacture and then pinched off. In an alternative construction taught in U.S. Pat. No. 3,363,134 — Johnson, a ceramic end cap is used having an externally projecting metal tube which is sealed off at its outer end. During operation of the lamps, the metal tube, which is sometimes referred to as the appendix, has the lowest temperature in the arc tube and becomes the cold spot where unvaporized sodium-mercury-amalgam collects. Its temperature determines the vapor pressure of sodium and mercury throughout the alumina arc tube.

A problem encountered with such lamps, particularly in the smaller sizes less than 200 watts, as in the 125 watt, 100 watt and 70 watt sizes, is too low a temperature at the appendix or cold spot location. In U.S. Pat. No. 3,723,784 — Sulcs et al., heat reflecting shields in the form of refractory metal foil bands are placed around the ends of the alumina tube next to the metal end caps. These shields are provided primarily to raise the temperature in the region of the seal and prevent amalgam condensation thereat, but they are also effective to raise the temperature of the metal exhaust tube. In general the wider the shield the greater the increase in temperature. However the use of wider shields or foils aone may not raise the temperature of the metal exhaust tube to the desired extent, and also the seal temperature may become excessive before the objective is achieved.

SUMMARY OF THE INVENTION

The object of the invention is to provide a practical and convenient means for raising the temperature of the metal tube without causing excessively high temperature at the seals between the end cap or closure and the alumina envelope.

In accordance with our invention, we provide within the exhaust tube a piece of metal of high heat conductivity, suitably molybdenum, which extends from the seal region towards the pinched end. The cross section and length of this piece are selected to increase the heat conduction to the liquid amalgam pool to the desired extent without raising the temperature at the seal between end closure and alumina envelope end.

DESCRIPTION OF PREFERRED EMBODIMENT

Figure 1:
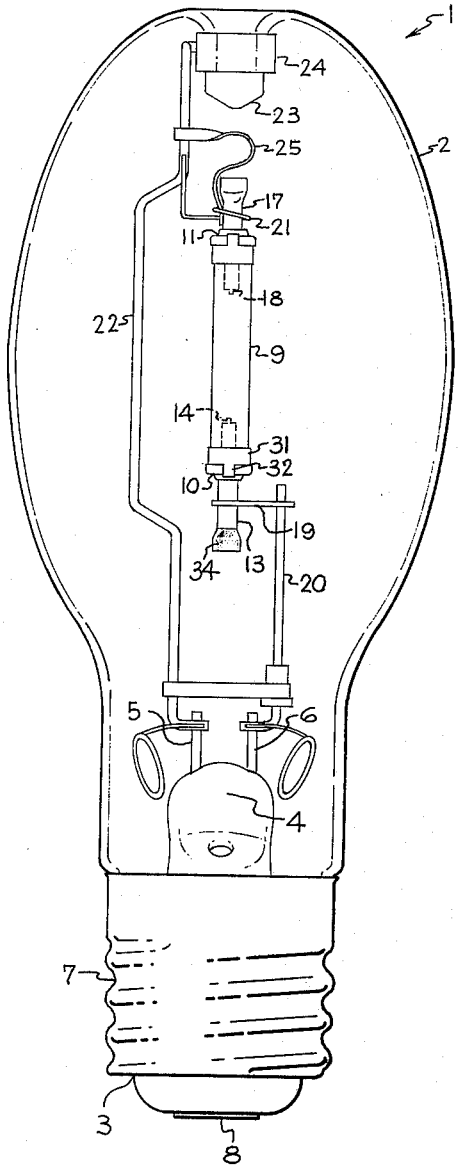
FIG. 1 illustrates a jacketed high pressure sodium vapor lamp embodying the invention.

A high pressure sodium vapor lamp of 70 watt rating embodying the invention in preferred form is illustrated in FIG. 1. The lamp 1 comprises an outer envelope 2 of glass to whose neck is attached a standard mogul screw base 3. The outer envelope comprises a re-entrant stem press 4 through which extend, in conventional manner, a pair of relatively heavy lead-in conductors 5,6 whose outer ends are connected to the screw shell 7 and eyelet 8 of the base.

The arc tube 9 centrally located within the outer envelope comprises a length of alumina ceramic tubing which, for ease of illustration, is shown as being clear whereas it is in fact translucent when made of polycrystalline alumina. The tube has its ends closed by end caps 10, 11 preferably of metal which matches closely the expansion coefficient of the alumina ceramic to which it is sealed by a glassy sealing composition 12. Niobium is preferred for the end caps but tantalum is also suitable. The lower end cap 10 has a metal tube 13 sealed through it which serves as an exhaust and fill tubulation during manufacture of the lamp. It is then pinched and sealed off at its outer end and serves as a reservoir in which excess sodium-mercury-amalgam condenses as a liquid during operation of the lamp. The lower electrode 14 within the lamp is attached to the inward projection of exhaust tube 13 and consists of double layer windings 15 of tungsten wire on a tungsten shank 16 which is welded in the crimped end of the exhaust tube. The electrode windings may be activated with $Ba_2CaWO_6$ contained in the interstices between turns. A dummy exhaust tube 17 extends through upper metal end cap 11 and supports upper electrode 18 in a similar way; it does not open into the interior of the arc tube and for this reason need not be hermetically sealed off at its outer end. The filling in the lamp comprises an inert gas, suitably xenon if maximum efficiency is desired or alternatively a Penning mixture of neon with a fractional percentage of argon if an easier starting lamp operating at a lower efficiency is acceptable. The metal charge may consist of 15 milligrams of amalgam of 17 weight percent sodium and 83 weight percent mercury.

The illustrated lamp is intended for base-down operation and has exhaust tube 13 rigidly connected by short wire connector 19 to support rod 20 which in turn is welded to inlead conductor 6. Provision for thermal expansion of the alumina tube is made by extending dummy exhaust tube 15 at the upper end through a ring support 21 attached to side rod 22 which in turn is fastened to lead-in conductor 5 and braced to inverted nipple 23 in the dome end of the envelope by a clip 24 which engages it. A flexible metal strap 25 spot welded to the dummy exhaust tube and to side rod 22 assures a good electrical contact to the upper electrode. In a similar lamp for base-up operation, the arc tube and its immediate connectors are inverted relative to the outer envelope.

Our invention is concerned with achieving the desired heat balance at the lower end of the arc tube and particularly in the metal exhaust tube or appendix 13. The end wall of cap 10 is pierced with an outwardly turned lip at 26 where a welded juncture is made to exhaust tube 13 extending through the piercing. The tungsten shank 16 of electrode 14 is welded in the crimped upper end 27 of the exhaust tube which projects into the arc tube beyond the end cap. The shank passes through a disc 28 which serves as a back arcing shield to prevent the arc from striking beyond the electrode to the interface of sealing glass and metal end cap at starting. The exhaust tube communicates with the interior of the arc tube through lateral openings 29. The pinched off lower end of the arc tube is the cold spot of the lamp and any excess unvaporized sodium-mercury-amalgam collects there as a liquid pool 30 whose temperature determines the vapor pressure of sodium and mercury in the arc tube.

In lamps of lower wattage it is difficult to operate at a sufficient amalgam temperature to achieve optimum performance. An increase in temperature can be obtained by means of a heat shield in the form of a thin metal band 31 wrapped around the end of the alumina tube. The band is of a material having a thermal emissivity less than the alumina ceramic, suitably polished niobium, tantalum, zirconium or molybdenum. The band is preferably in contact with the edge of the end cap 10 and may be attached to it by means of tabs 32 bent around the end cap to provide a lock. Widening the band so that it covers more of the alumina tube end increases the heating. However with some lamp designs the exhaust tube cannot be sufficiently heated by this means. Also with some lamps such as the 70 watt lamp illustrated, overheating of the sealing glass 12 at the end cap-glass interface occurred before the optimum amalgam pool temperature of about 700°C could be achieved. For either reason, another solution to the problem is required.

Figure 2:
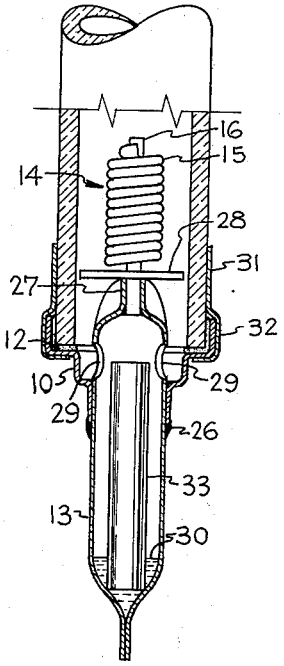
FIG. 2 is a sectioned view of the lower end of the arc tube to a larger scale showing details of the end cap and exhaust tube containing a heat-conducting slug.

In accordance with our invention, additional heat is supplied to the exhaust tube by a solid body which is a good heat conductor placed in the exhaust tube and extending from the seal region towards the tip. One way of doing this is simply to extend the electrode shank 16 beyond the crimp in the upper end of the exhaust tube and into the interior of the exhaust tube. However the same effect can be obtained at lower cost by the simple expedient of inserting a separate free slug or length of conductive wire 33 as illustrated in FIG. 2 into the exhaust tube before pinching off the end. By so doing the slug may be chosen from a wider range of materials and also it may be made of larger diameter wire than that used for the electrode shank. Examination of thermal conductivity, cost and thermal emissivity of various materials has led to the choice of molybdenum as best for the desired effect.

In experimental work on the 70 watt lamp illustrated, it was found that when radiation shields are used alone to increase the temperature of the exhaust tube and achieve the design voltage of the lamp, the seals operate at too high a temperature for long life. It is desirable to have a non-polished end on the exhaust tube as shown at 34 in FIG. 1, in order to increase locally the thermal emissivity. This cools the end and assures a well-defined cold spot location of the amalgam at the pinched end. Such roughening is generally done by a grit blast and the height or extent of the grit blast may be varied to attain the desired cooling effect. Without the grit blast the exhaust tube tends to be relatively uniform in temperature and amalgam may locate at the seal area as well as within the exhaust tube, causing the operating voltage to become variable and performance to be degraded.

Table 1 below gives the measured voltage drop across a 70-watt lamp for different grit blast heights in three different lamps indicated A, B and C. Lamp A corresponds to the prior art, lamp B contains a slug of 0.047 inch diameter tungsten wire, 8.5 millimeters long within the exhaust tube, while lamp C contains two such slugs. These lamps had no heat shields.

TABLE 1

| Grit Blast Height(mm) | LAMP VOLTAGE AT 70 WATTS Lamp A No Slug | Lamp B 1-.047"×8.5mm | Lamp C 2-.047"×8.5mm |
|---|---|---|---|
| 7 | 33.5 v | 39.2 v (+17%) | 42.5 v (+27%) |
| 4 | 35.8 v | 44.0 v (+23%) | |
| 0 | 41.0 v | | |

It is observed that increases in lamp voltage of 17 and 27% are obtained through the use of an internal slug even with a severe grit blast of 7 millimeters height. But a lamp voltage of about 50 volts or better is desired and to obtain it a larger slug capable of conducting more heat is required. However it was also found that the slug under these conditions tends to draw too much heat from the seal region and may cause it to become the cold spot location. Accordingly our preferred construction uses both a heat shield around the tube end and a slug in the exhaust tube. Results for three lamps D, E and F, all provided with a heat shield 3 mm wide and grit blast height of 4 mm are compared in Table 2 below.

TABLE 2

| LAMP VOLTAGE AT 70 WATTS Lamp D No Slug | Lamp E Slug: .060"×8.5mm | Lamp F Slug: .060"×9.5mm |
|---|---|---|
| 43.2 v | 54.9 v (+27%) | 57.6 v (+33%) |

The preferred construction for a 70-watt lamp utilizes a molybdenum slug 0.060 inch diameter by 8.5 millimeters long in the exhaust tube, a heat shield 3 millimeters long around the tube end, and a grit blast height of 4 millimeters measured from the tip of the exhaust tube. The fact that the slug is loose in the exhaust tube and may move has no deleterious effect in the lamp which has been described. Hand shake testing and lamp inversion were used to evaluate the effect of the loose slug on lamp operating voltage. A shift of about 2 volts is all that occurred when the slug was moved from one end of the exhaust tube to the other. The desired lamp voltage in excess of 50 volts is achieved without excessive cooling or heating of the end cap seal region, and with a well defined cold spot at the end of the exhaust tube where excess sodium mercury amalgam condenses making for stable operation.

In mass production of high pressure sodium vapor lamps, the sodium-mercury amalgam charge is dispensed to the arc tube by a mechanical measuring device. If the device is allowed to get out of adjustment, considerable variation in the weight of the charge may occur. In the present lamp containing a heat-conducting slug, when variations in charge occur together with movement of the slug in the exhaust tube, voltage shifts in excess of 2 volts may result. For instance when 70 and 125 watt production lamps containing a molybdenum slug in the exhaust tube are turned from vertical to horizontal operation, the lamp operating voltage may shift more than permitted by the specifications.

Figure 3:
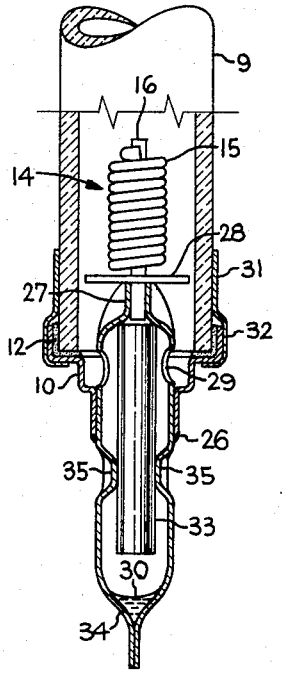
FIG. 3 is a view similar to FIG. 2 wherein the exhaust tube is crimped to lock the slug in place.
Figure 4:
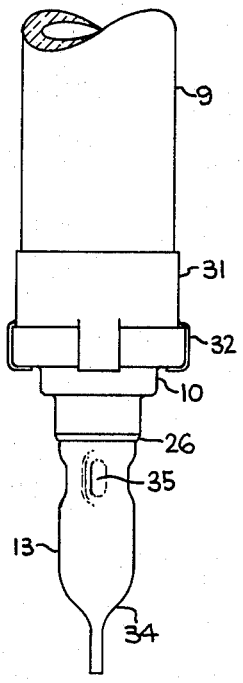
FIG. 4 is a side elevation corresponding to FIG. 3.

The increased sensitivity to charge variations in these lamps is probably due to amalgam being located temporarily along the slug within the exhaust tube rather than at the thermally well defined cold spot location at the pinched end. We have found that the variations in lamp voltage can be kept within the levels permitted by the lamp specifications by the simple expedient of locking the slug in place so it cannot move about within the exhaust tube. FIGS. 3 and 4 show such a lamp wherein the molybdenum slug 33 is locked in place by crimping the exhaust tube wall at 35. Preferably the slug is displaced towards the electrode before crimping so that there is a gap between its outer end and the exhaust tube walls, and contact with the sodium-mercury amalgam 30 collected at the cold spot region 34 is avoided. The illustrated crimping is but one way of deforming the exhaust tube wall in order to prevent movement of the slug.

The invention has been described in detail with reference to a lamp using metal end caps, but it is equally applicable to a lamp using ceramic end caps where one cap has an externally projecting metal tube sealed through it. When such tube opens into the interior of the arc tube and is closed off at its outer end, it can serve as the cold spot where the amalgam pool forms. A piece of conductive metal within the metal tube in accordance with our invention then provides a means for increasing the amalgam pool temperature without excessive rise in the seal temperature.

What we claim as new and desire to secure by Letters Patent of the United States is:

1. A high pressure alkali metal vapor discharge lamp comprising:

a slender light-transmissive ceramic tube having closures sealed to opposite ends and electrodes supported thereby; a filling of alkali metal in excess of the quantity vaporized in operation and an inert gas within said tube;

at least one of said closures comprising a metal tube extending hermetically therethrough;

said metal tube supporting the electrode at its inner end, having an opening into the ceramic tube, and being closed at its outer end to provide a reservoir for condensed alkali metal;

and metal of high heat conductivity enclosed within said metal tube and extending from the region of the end of the ceramic tube towards the closed end of said metal tube, said metal serving to raise the temperature of the amalgam condensed at the closed end of said metal tube.

2. A lamp as in claim 1 wherein said metal is a separate metal slug.

3. A lamp as in claim 2 wherein the metal tube is deformed to prevent movement of the metal slug within it.

4. A lamp as in claim 1 wherein a heat shield comprising a metal band having an emissivity less than said ceramic is wrapped around the end of the ceramic tube.

5. A lamp as in claim 1 wherein the closed outer end of said metal tube is roughened to increase its thermal emissivity and assure a well-defined cold spot.

6. A high pressure sodium vapor discharge lamp comprising:

a slender light-transmissive ceramic tube having closures and electrodes supported thereby at opposite ends;

a filling of sodium-mercury amalgam in excess of the quantity vaporized in operation and an inert gas within said tube;

at least one of said closures comprising a metal end cap into which the end of the ceramic tube is sealed by sealing material and a metal tube extending hermetically through the end wall of said cap;

said metal tube supporting the electrode at its inner end, having an opening into the ceramic tube, and being closed at its outer end to provide a reservoir for condensed amalgam;

and a length of metal of high heat conductivity enclosed within said metal tube and extending from the region of the end of the ceramic tube towards the closed end of said metal tube, said metal serving to raise the temperature of the amalgam condensed at the closed end of said exhaust tube.

7. A lamp as in claim 6 wherein said length of metal is a separate metal slug.

8. A lamp as in claim 7 wherein said metal slug is of molybdenum.

9. A lamp as in claim 7 wherein the metal tube is deformed to prevent movement of the metal slug within it.

10. A lamp as in claim 7 wherein the metal tube is crimped to lock the metal slug within it and the slug is displaced toward the electrode.

11. A lamp as in claim 6 wherein a heat shield comprising a metal band having an emissivity less than said ceramic is wrapped around the end of the ceramic tube next to said metal end cap.

12. A lamp as in claim 6 wherein the closed outer end of said metal tube is roughened to increase its thermal emissivity and assure a well-defined cold spot.

* * * * *